United States Patent [19]

Ruth

[11] Patent Number: 4,657,265

[45] Date of Patent: Apr. 14, 1987

[54] CONVERTIBLE SKATE

[76] Inventor: Paul M. Ruth, 5011 Pine Lake Village Apartments, Lindenwold, N.J. 08021

[21] Appl. No.: 808,927

[22] Filed: Dec. 13, 1985

[51] Int. Cl.[4] ..... A63C 17/18

[52] U.S. Cl. ..... 280/7.13; 280/11.1 BR; 280/11.27; D21/226

[58] Field of Search ..... 280/7.13, 7.14, 11.1 BR, 280/11.19, 11.27, 11.28, 11.3, 87.04 A; D21/225, 226

[56] References Cited

U.S. PATENT DOCUMENTS

| | | | |
|---|---|---|---|
| 177,566 | 5/1876 | Saladee | 280/11.27 |
| 214,563 | 4/1879 | Harwood | 280/7.14 |
| D. 226,440 | 3/1973 | Bentley | D21/226 |
| 526,655 | 9/1894 | Johnson | 280/7.13 X |
| 584,089 | 6/1897 | Buttermilch | 280/11.27 X |
| 904,088 | 11/1908 | Rother | 280/11.1 BR |
| 945,435 | 1/1910 | Anderson | 280/7.14 |
| 992,443 | 5/1911 | Oldfield | 280/7.14 |
| 1,010,105 | 11/1911 | Zippel | 280/7.14 |
| 1,024,835 | 4/1912 | Doak | 280/11.1 R |
| 1,243,077 | 10/1917 | Kuchtik | 280/7.14 |
| 2,049,598 | 8/1936 | Tubbs | 36/100 |
| 2,118,892 | 5/1938 | Mays | 280/7.14 |
| 2,150,814 | 3/1939 | Barbato | 280/11.27 |
| 2,195,348 | 3/1940 | Wiseley | 280/7.14 |
| 2,209,116 | 7/1940 | Friedmann | 280/7.13 |
| 2,454,321 | 11/1948 | Howard | 280/7.13 |
| 2,664,294 | 12/1953 | Kleinman | 280/11.27 |
| 2,706,119 | 4/1955 | Uphoff | 280/11.3 |
| 2,868,553 | 1/1959 | Rieckman | 280/7.13 |
| 2,874,970 | 2/1959 | Mall | 280/7.13 |
| 2,998,260 | 8/1961 | Meyer | 280/7.13 |
| 3,235,282 | 2/1966 | Bostick | 280/11.27 X |
| 3,281,971 | 11/1966 | Weitzner | 36/134 |
| 3,526,976 | 9/1970 | Jacobs | 280/7.14 X |
| 3,827,706 | 8/1974 | Milliman | 280/11.1 BT |
| 3,918,729 | 11/1975 | Peters | 280/11.3 |
| 4,008,901 | 2/1977 | Conn | 280/7.13 |
| 4,034,995 | 7/1977 | Forward | 280/11.23 |
| 4,058,324 | 11/1977 | Dallaire | 280/11.22 |
| 4,114,295 | 9/1978 | Schaefer | 36/100 |
| 4,150,499 | 4/1979 | Wang | 36/115 |
| 4,328,627 | 5/1982 | Sanders | 36/115 |
| 4,460,187 | 7/1984 | Shimizu | 280/11.1 BT |
| 4,572,529 | 2/1986 | Thomas | 280/11.1 BR |

FOREIGN PATENT DOCUMENTS

| | | | |
|---|---|---|---|
| 1053278 | 4/1979 | Canada . | |
| 0032057 | 7/1981 | European Pat. Off. . | |
| 523923 | 4/1955 | Italy . | |
| 572985 | 2/1958 | Italy | 280/11.19 |
| 52-6241 | 1/1977 | Japan | 280/11.1 BR |
| 14114 | 4/1926 | Netherlands . | |
| 2249 | of 1876 | United Kingdom | 280/11.19 |

*Primary Examiner*—John J. Love
*Assistant Examiner*—Michael Mar
*Attorney, Agent, or Firm*—Panitch Schwarze Jacobs & Nadel

[57] ABSTRACT

The present invention relates to a convertible skate comprising a shoe assembly including a flanged beam attached to and extending downwardly from a sole plate which is attached to the bottom of the shoe and a skate assembly including a channel having inwardly extending flanges extending laterally from the sides of the channel and adapted to extend between the sole plate and the outwardly laterally extending flanges of the beam. The flanged channel may bear roller skating trucks or it may bear pedestals attached to a blade adapted for ice skating. This invention also relates to three-wheeled roller skates having a single central front roller ball wheel and a rear truck having a pair of conventional, disc-shaped wheels. The surface of the roller ball has a plurality of continuous, circular grooves perpendicular to an axis of rotation of the roller ball which lies in a plane parallel to the surface engaged by the surface of the roller ball.

12 Claims, 4 Drawing Figures

CONVERTIBLE SKATE

BACKGROUND OF THE INVENTION

This invention relates to skates and more particularly to convertible skates which may be used interchangeably for roller skating and ice skating. Further, this invention relates to novel three-wheeled roller skates having pivotable front roller balls and conventional two-wheeled rear trucks. This invention also relates to a skate mounting system which permits ice skating or roller skating assemblies to be interchangeably, yet securely, fastened to the same shoe assembly.

Conventional skates consist of shoes having either ice skating or roller skating subassemblies permanently mounted on their undersides. A metal sole plate is usually affixed to the sole and heel of the shoe or boot by rivets, screws, or the like. In the case of ice skates, the sole plate is fitted with at least a pair of pedestals extending between the sole plate and an ice contacting blade. Roller skates usually have a pair of skate trucks or sliders mounted directly on the sole plate. Because the ice skating assemblies and roller skating assemblies are permanently affixed to conventional skates, individuals who wish to participate in both sports must acquire a pair of each type of skates. While interchangeable skates are known in the art, they do not provide the quickly interchangeable, securely mounted skate assemblies of the present invention. In addition, the present invention provides skates having enhanced rigidity permitting greater control of the skates by the skater.

SUMMARY OF THE INVENTION

The present invention relates to a convertible skate comprising a shoe assembly and a skate assembly removably attachable to the shoe assembly, the shoe assembly including support member attachment means comprising a sole plate attached to the bottom of a shoe, a beam extending downwardly from the sole plate, the beam having an outwardly laterally extending pair of flanges spaced from the sole plate, the skate assembly including a support member which bears means for engaging a surface.

In the present invention the convertible skate comprises a shoe assembly including support member attachment means, and a skate assembly including a support member which bears means for engaging a surface, such as a paved surface, a wooden floor, or an icy surface. The support member attachment means comprises a flanged beam attached to and extending downwardly from a sole plate which is attached to the bottom of the shoe. The support member attachment means may extend substantially the length of the bottom of the skate shoe. Preferably, the sole plate extends substantially the length of the shoe and the beam of the support member attachment means extends substantially the length of the sole plate of the skate shoe.

The flanged beam has outwardly laterally extending flanges spaced from the sole plate. The flanges of the support member attachment means may extend perpendicularly to the beam. Preferably, the flanges are formed in coplanar pairs. In one preferred embodiment, the support member attachment means includes a beam from which extends a single pair of outwardly laterally extending flanges. The beam is attached to a sole plate which is in turn attached to the sole and heel of the shoe assembly. It is preferred that a pair of bilaterally symmetric flanges extending outwardly and laterally from the beam be provided and that the lower surfaces of this pair of flanges be co-extensive with the lower surface of the beam.

The support member comprises a support element having at least two channels formed by flanges extending inwardly and laterally from the sides of the support element, and adapted to extend between the sole plate and the outwardly laterally extending flanges of the beam. Preferably, at least one surface of the support member contacts a mating, opposed surface of the beam of the support member attachment means. It is further preferred that a pair of flanges extend from the beam of the support member attachment means such that the lower surfaces of the flanges are coextensive with the lower surfaces of the beam and that the coextensive lower surfaces of the flanges and the beam contact an opposed mating upper surface of the support member. In addition, or in the alternative, the upper surfaces of the flanges of the support member may contact opposed mating portions of the lower surface of the sole plate. Preferably, the contacting surfaces of the support member and the support member attachment means are in contact extending substantially the length of the sole plate of the skate shoe.

In one embodiment, the sole plate, the beam, and the flanges of the support member are integral. It is also preferred that the support member be locked to the beam by means which are easily engagable and disengagable, such as set screws. The support member may bear roller skating trucks or it may bear pedestals attached to a blade adapted for ice skating.

This invention also provides novel three-wheeled roller skates having a single central front roller ball wheel and a rear truck having a pair of conventional, disc-shaped wheels. In one embodiment, it is preferred that the forward truck of a roller skating assembly according to the present invention bear a single roller ball pivotably mounted so as to pivot about a generally vertical axis perpendicular to a generally horizontal axis of rotation which lies in a plane parallel to the surface which is engaged by the exterior surface of the roller ball. It is also preferred that the surface of the roller ball have a plurality of continuous, circular grooves disposed perpendicular to the generally horizontal axis of rotation of the roller ball. The ball wheel axle is supported at each end by a yoke which is pivotably attached to the support member of the skate assembly.

BRIEF DESCRIPTION OF THE DRAWINGS

For the purpose of illustrating the invention there is shown in the drawings forms which are presently preferred; it being understood, however, that the invention is not limited to the precise arrangements and instrumentalities shown.

DETAILED DESCRIPTION OF THE PREFERRED EMBODIMENTS

Figure 1:
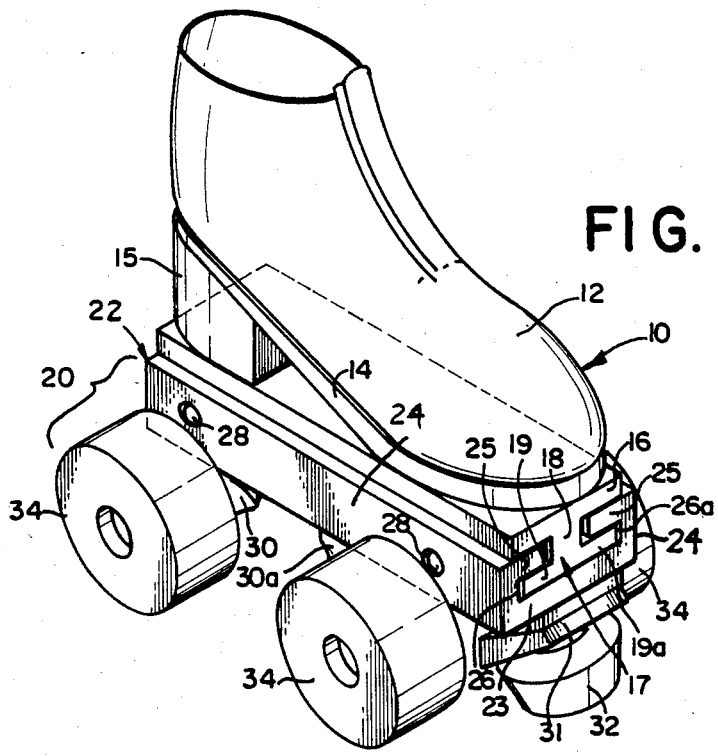
FIG. 1 is an isometric view of a first presently preferred embodiment of the present invention. In this embodiment, the skate carries conventional two wheel roller skating trucks.

Referring now to the drawings, in which like reference numerals identify like elements throughout the several views, there is shown in FIG. 1 an isometric view of a skate shoe according to the present invention having a pair of conventional roller skating trucks. The skate shoe includes a shoe assembly 10, comprising a shoe upper 12 which has a relatively low ankle. However, shoe upper 12 may be a boot with a relatively high ankle portion to provide support to the ankle of the wearer as is conventionally provided in ice skates and roller skates. To shoe upper 12 are affixed a sole 14 and a heel 15 by conventional means. Alternatively, the illustrated sole 14 and heel 15 may be replaced with a single, monolithic sole extending the entire length beneath the shoe upper 12. This extended sole may be a molded synthetic polymeric material, such as polyurethane or other suitably rigid synthetic or natural material.

In the embodiment illustrated in FIG. 1, a sole plate 16 and a mount 17 together comprise the support member attachment means. To the lower surface of the sole 14 and heel 15 is permanently affixed a sole plate 16 by means of rivets, screws, adhesive, or the like. Alternatively, the mount 17 may be in part contained within the sole 14 and/or heel 15. The mount 17 consists of a beam 18 and having outwardly radially extending flanges 19, **19*a*. The mount 17 is attached to the sole plate 16. In the embodiment illustrated in FIG. 1, the sole plate 16 and the mount 17 including the beam 18 and flanges 19, 19*a* are integral and may be a single casting or extrusion. Alternatively, the sole plate 16 and the mount 17 may be separate parts secured together by any conventional means, such as by welding, as may the the beam 18 and flanges 19, 19*a* which together comprise the mount 17. The sole plate 16 and mount 17 illustrated in FIG. 1 preferably are integrally formed of a high strength aluminum alloy. However, the sole plate 16 and mount 17, or a unitary member made up of the sole plate 16 and mount 17**, may be manufactured from cast or extruded metal, such as steel, lightweight metal alloy, or the like, or a rigid synthetic polymeric material, such as polyurethane, polyacetal, polyamide or the like.

The sole plate 16 and mount 17 function as means for attaching the support member to the skate shoe. Different support members bearing different means for engaging various types of surfaces may be interchanged as desired. The structure of the sole plate 16 and mount 17 function to rigidly attach the support member to the shoe assembly, giving good structural support to the shoe assembly. The rigid attachment of the support member is important for skating, since it permits foot and leg motion to be accurately transmitted to the wheels or blades permitting good control.

In the embodiment illustrated in FIG. 1, a single pair of flanges 19, **19*a* extend laterally outwardly from the beam 18. The lower surfaces of the single set of flanges may be coextensive with the lower surface of the beam 18, giving the appearance of an inverted "T" as illustrated in FIG. 1, or the flanges 19, 19*a* may have lower surfaces which are not coextensive with the lower surface of the center beam 18, but rather are spaced above the lower surface of the center beam 18, giving the appearance of a "+" in a front elevational view (not illustrated). Moreover, the flanges 19, 19*a*** may be symmetrical as illustrated, or asymmetrical, to facilitate attachment of a skate assembly in only one proper orientation.

With further reference to FIG. 1, the sole plate 16 and mount 17 both extend the entire length of the shoe assembly 10. However, either the sole plate 16 or the mountplate 17 or both may extend longitudinally for a distance less than the entire length of the shoe assembly 10. In another embodiment (not illustrated) the mount consists of multiple individual mount elements having the same general cross section and orientation as the mount 17 illustrated in FIG. 1, but which have a significantly shorter longitudinal length than that of the illustrated mount 17. For example, one such individual mount element may be affixed to a sole plate affixed to the sole 14 of the shoe assembly 10 (not illustrated) while at the same time an identical such mount element may be affixed to a heel plate affixed to the heel 15 of the shoe assembly 10 (not illustrated). However, to achieve increased rigidity, a mount 17 extending substantially the length of the skate shoe is preferred.

As illustrated in FIG. 1, the sole plate 16 is rectangular in plan view. However, the shape of the sole plate 16 may be varied from that illustrated in FIG. 1. For example, the sole plate 16 may have the same general shape as that defined by the bottom of the sole 14 and heel 15 (not illustrated).

As illustrated in FIG. 1, skate assembly 20, which is attached to the shoe assembly 10 to form this illustrated embodiment, comprises a skate frame or support member 22 which engages the mount 17 of the shoe assembly 10 and to which are attached roller skating trucks 30 and **30*a* and a wedge member 31 carrying a toe stop 32. Each of the two trucks 30 and 30*a* carries a pair of wheels 34** connected by an axle which is mounted within the respective trucks.

The support member 22 includes a base plate 23 and sides 24 which extend upwardly from the edges of the base plate 23, and flanges 25 extending inwardly from the sides 24. In the embodiment illustrated in FIG. 1, the flanges 25 and base plate 23 are disposed in a parallel but spaced relation so that, together with sides 24, they form a pair of channels 26, **26*a* which are adapted to receive the flanges 19, 19*a* of the mount 17 when the skate assembly 20 is secured to the shoe assembly 10**.

Preferably, at least one surface of the support member contacts an opposed, mating surface of the support member attachment means. In the embodiment illustrated in FIG. 1, the coextensive lower surfaces of the flanges 19, **19*a* and the beam 18 of the mount 17 of the support member attachment means contact the opposed, mating upper surface of the base plate 23 of the support member 22. Additionally, or in the alternative, the upper surfaces of the flanges 25 of the support member may contact opposed mating portions of the lower surface of the sole plate 10 of the support member attachment means. Preferably, the contacting surfaces of the support member 22 and the support member attachment means are in contact extending substantially the length of the sole plate 16 of the skate shoe assembly 10. In the embodiment illustrated in FIG. 1, the lower surface of the mount 17 of the support member attachment means contacts the opposed, mating upper surface of the base plate 23 of the support member 22 for a length extending the length of the sole plate 16. Preferably, the contact between the upper surfaces of the flanges 25 and the lower surface of the sole plate 16 and the contact between the lower surfaces of the flanges 19, 19*a* and beam 18** and the upper surface of the base plate 23 is such that the shoe assembly 10 and the skate assembly 20 may be easily assembled together and held by a friction fit.

Like the sole plate 16 and mount 17, the support member 22 may be made to be a single integral part or a combination of parts secured together. It is preferred that the support member be formed from a single piece of rigid material of the type discussed above with respect to the sole plate 16 and mount 17.

While the support member 22 may have inwardly extending flanges 25 which are the same size and shape as each other and are symmetrically located on the support member, as illustrated in FIG. 1, they may have other shapes and be asymmetrical so long as they form channels which mate with the sole plate 16 and mount 17 forming the support member attachment means.

The support member 22 is held in place on the mount 17 by fasteners, for example, by set screws 28 located within the sides 24 of the support member 22. The set screws 28 are tightened until they engage the sides of the flanges 19, 19*a* of the mount 17 of the shoe assembly 10. The sides of the lower plate 19 may be recessed to receive set screws 28 when the set screws 28 are tightened and to lock the support member 22 to the mount 17 in a predefined manner. Alternatively, screws passing through holes in the sides 24 can be screwed into aligned holes formed in the mount 16. The set screws are located to allow the skate assembly 20 to be easily engagable and disengagable with the shoe assembly 10.

In another embodiment (not illustrated), at least one other pair of flanges extend laterally inwardly from the sides 24 of the support member 22 in parallel spaced relation with respect to both the top flanges 25 and the bottom plate 26. Thus, multiple channels (not illustrated) are defined by the combination of at least two pairs of inwardly extending flanges, including the top flanges 25, the sides 24 and the bottom plate 26. In this embodiment, the multiple channels in the support member 22 are adapted to mate with multiple flanges extending outwardly from the center beam 18 of the mount 16 (not illustrated).

Figure 2:
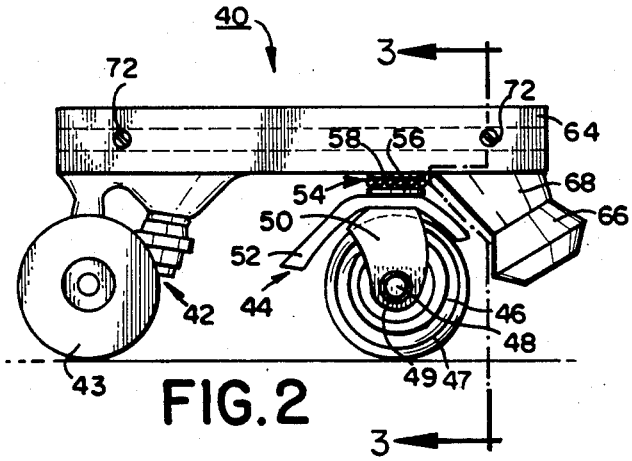
FIG. 2 is a side elevation of a three wheel skate assembly of a second presently preferred embodiment of the present invention.
Figure 3:
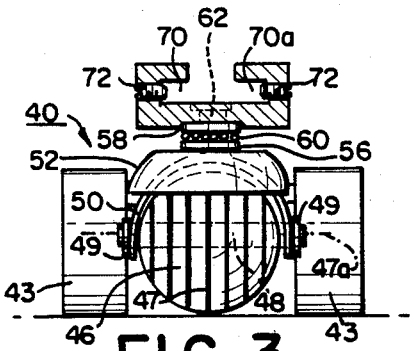
FIG. 3 is a partially sectional view taken along line 3—3 of the three wheel skate assembly illustrated in FIG. 2.

Referring now to FIGS. 2 and 3, there is illustrated a second presently preferred embodiment of the present invention. FIG. 2 is a side elevation of a three-wheeled skate assembly 40 of this second embodiment. The rear roller truck 42, illustrated in FIG. 2 may be the same as the rear truck 30 illustrated in FIG. 1, or may be any other type well known to those skilled in the art carrying two typical disc shaped wheels 43. The rear roller truck 42 is mounted to a skate support member 64 by conventional mounting means permitting the steering of the rear truck by tilting of the sole plate 16 when the skate assembly 40 is mounted on the mount 17 of the shoe assembly 10. The skate assembly 40 differs from the skate assembly 20 illustrated in FIG. 1, in that the front truck 30*a* illustrated in FIG. 1 is replaced with a roller truck 44, illustrated in FIG. 2. In the front truck 44 a ball wheel 46 having parallel, circular, circumferential grooves 47 oriented perpendicular to an axis of rotation 47*a* of the ball wheel 36, rotates about an axle 48 which is supported at either end by a yoke 50. This axis of rotation 47*a* of the ball wheel 36 lies in a generally horizontal plane which is parallel to the surface which is engaged by the exterior surface of the ball wheel 36. A circumferential groove spaced a short distance from either end of the axle 48 accepts split rings 49, which retain the axle within the yolk.

As illustrated in FIG. 3, a partial sectional view taken along line 3—3 of FIG. 2, the yoke 50 extends between either end of the axle 48 and over the top of the ball wheel 46. An optional decorative fender 52 which extends proximate the top of ball wheel 46 in generally spaced relation away from the surface of the ball wheel 46 may be attached by any suitable means to the yoke 50.

The front truck is attached to a skate support member 64 by a ball bearing assembly 56 and rotatable shaft means 62. The ball bearing assembly 54 includes a lower bearing race 56 attached to the yoke 50 and the fender 52. An upper bearing race 58 is attached to the skate support member 64, ball bearings 60 travel in grooves formed in the lower and upper bearings races 56 and 58. The bearing assembly is held together and attached to the support member 64 by a typical rotatable shaft means 62 which allows the wheel 46, the yoke 50 and the fender 52 to rotate about the generally vertical axis of the shaft means 62.

As illustrated in FIG. 2, a toe stop 66, made from a soft resilient material, is attached by a member 68 to the support member 64 in the usual manner.

It is easy to substitute the three-wheeled skate assembly of FIGS. 2 and 3 for the skate assembly 20 of FIG. 1 on the shoe assembly 10 of FIG. 1. To do so, one merely removes the skate assembly 20 from the shoe assembly 10 by unscrewing the screws 28 and sliding the skate support member 22 off of the support member attachment means comprised of the sole plate 16 and the mount 17.

The support member 64 of the three-wheeled skate embodiment of FIGS. 2 and 3 has the same general shape as the support member 22 of the embodiment illustrated in FIG. 1. Thus, the support member 64 includes channels 70 and 70*a* which receive flanges 19 and 19*a* extending from the beam 18 of the mount 17. Then support member 64 is secured to the support member attachment means by tightening screws 72 until they firmly engage the sides of the flanges 19 and 19*a*. The three-wheeled skate assembly 40 may be desired by a skater in place of the usual four-wheeled skate assembly 20 because certain maneuvers, particularly in figure skating, are easier to perform with a three-wheeled skate assembly where the front wheel is a rolling ball which can also rotate about a vertical axis. It is believed that a three-wheeled skate as illustrated and described herein will allow greater maneuverability and better and easier control as compared to four-wheeled skates. The vertically oriented circular grooves 47 of the roller ball 46 also contribute to increased skating performance. The grooves help overcome potential side slipping and provide better tracking action. The structural stability provided by a support and attachment system of the present invention contributes to these and enhances skating characteristics provided by the three-wheeled skate of the present invention.

Figure 4:
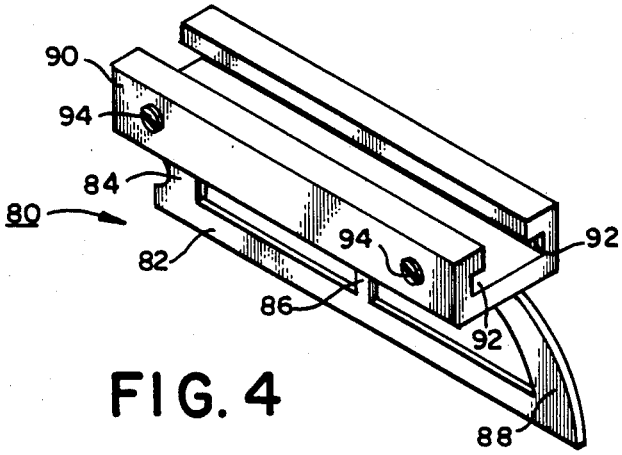
FIG. 4 is an isometric view of an ice skating assembly of a third embodiment according to the present invention.

FIG. 4 is an isometric view of an ice skating assembly 80 of a third embodiment of the present invention. An ice skating blade 82 is integrally formed with or permanently attached by any suitable means to pedestals 84, 86 amd 88. The pedestals are attached, as by welding, for example, to a skate asesmbly support member 90. As in the cases of the other two illustrated embodiments, channels 92, formed in the support member 90, receive the bottom plate 26 of the mount 16 of the shoe assembly 10. Screws 28 secure the ice skating assembly 80 to the shoe assembly 10. The forward tip of the skate blade 82 may be provided with teeth (not illustrated) for figure skating if desired. Similarly, multiple pedestals and parallel blades may be provided for skates adapted for children. The ice skating assembly 80 may be easily attached to the shoe assembly 10 of FIG. 1 in place of the four-wheeled skate assembly 20 of FIG. 1, the three-wheeled skate assembly 40 of FIGS. 2 and 3, or any other embodiment having a support assembly compatible with the support assembly attachment means of the shoe assembly.

It will be recognized by those skilled in the art that changes may be made to the three above described interchangeable embodiments of the invention without departing from the broad inventive concepts thereof. Additional types of skate assemblies employing the novel mount and support system of the present invention may also be used with a mating shoe assembly within the scope of the present invention. Accordingly, reference should be made to the appended claims, rather than to the foregoing specification, as indicating the scope of the invention.

I claim:

1. A convertible skate comprising a shoe assembly including a shoe and a skate assembly removably attachable to the shoe assembly, the shoe assembly including support member attachment means comprising a sole plate attached to the bottom of the shoe, the sole plate having a flat upper surface extending substantially the width of the shoe, a beam extending downardly from the sole plate, the beam having an outwardly laterally extending pair of flanges spaced from the sole plate, the skate assembly including a support member which bears means for engaging a surface, the skate assembly having means to releaseably secure the support member to the support member attachment means, the skate assembly support member comprising a support element having at least two channels formed by inwardly laterally extending flanges adapted to extend substantially the length of the shoe between the sole plate and the outwardly laterally extending flanges of the beam, the skate assembly further comprising front and rear roller skating truck assemblies mounted thereunder, the rear truck assembly bearing a pair of wheels and being mounted to the support member by mounting means permitting steering of the rear truck assembly by tilting of the sole plate, the front truck assembly bearing a single roller ball and being affixed to the support member and pivotable about a vertical axis.

2. A convertible skate according to claim 1 wherein the sole plate extends substantially the length of the shoe and wherein the beam of the support member attachment means extends substantially the length of the sole plate of the skate shoe.

3. A convertible skate according to claim 2 wherein the flanges extend from the beam such that the lower surfaces of the flanges are co-extensive with the lower surface of the beam.

4. A convertible skate according to claim 1 wherein the support member is attached to the beam by set screws.

5. A convertible skate according to claim 1 wherein the surface of the roller ball has continuous, circular grooves oriented perpendicular to an axis of rotation of the roller ball and the axis of rotation lies in a plane parallel to the surface which is engaged by the exterior surface of the roller ball.

6. A convertible skate according to claim 1 wherein at least one surface of the support member contacts an opposed mating surface of the support member attachment means.

7. A convertible skate according to claim 6 wherein flanges and the beam of the support member attachment means have coextensive lower surfaces and wherein the coextensive lower surfaces of the flanges and the beam of the support member attachment means contact an opposed mating upper surface of the support member.

8. A convertible skate according to claim 7 wherein the upper surfaces of the flanges of the support member contact opposed mating portions of the lower surface of the sole plate.

9. A convertible skate according to claim 8 wherein the contacting surfaces of the support member and the support member attachment means are in contact extending substantially the length of the sole plate of the skate shoe.

10. A convertible skate according to claim 1 wherein the sole plate, the beam, and the flanges of the support member attachment means are integral.

11. A convertible skate according to claim 1 wherein the flanges of the support member attachment means extend perpendicular to the beam.

12. A convertible skate according to claim 1 wherein the support member attachment means includes a beam from which extend a single pair of outwardly laterally extending flanges.

* * * * *